United States Patent [19]

Fischley et al.

[11] 4,429,860

[45] Feb. 7, 1984

[54] RUNNER SYSTEM FOR TRANSFERRING MOLTEN METAL

[75] Inventors: John Fischley, Chagrin Falls, Ohio; Tom E. Anderson, Munster, Ind.

[73] Assignee: Republic Steel Corporation, Cleveland, Ohio

[21] Appl. No.: 361,206

[22] Filed: Mar. 24, 1982

[51] Int. Cl.[3] ..... C21B 7/14

[52] U.S. Cl. ..... 266/44; 266/196; 222/602

[58] Field of Search ..... 266/196, 236, 44; 75/46, 41, 42; 222/591, 592, 593, 597–602

[56] References Cited

U.S. PATENT DOCUMENTS

| | | | |
|---|---|---|---|
| 912,688 | 2/1909 | Killeen | 266/196 |
| 1,086,884 | 2/1914 | Benton | 266/196 |
| 1,210,091 | 12/1916 | McDonald | 266/196 |
| 1,336,767 | 4/1920 | Warren | 222/591 |
| 1,611,212 | 12/1926 | Lose | 266/196 |
| 1,726,581 | 9/1929 | Orbin | 222/591 |
| 2,139,949 | 12/1938 | Forsythe et al. | 266/196 |
| 3,365,187 | 1/1968 | French | 266/196 |
| 3,830,281 | 8/1974 | Snider | 222/591 |

FOREIGN PATENT DOCUMENTS

| | | | |
|---|---|---|---|
| 1253550 | 1/1961 | France | 266/236 |
| 7876 | of 1906 | United Kingdom | 266/196 |

*Primary Examiner*—M. J. Andrews

*Attorney, Agent, or Firm*—Watts, Hoffmann, Fisher & Heinke Co.

[57] ABSTRACT

An apparatus and method including a runner system for transferring molten metal from a blast furnace to transfer cars. The runner system comprises a single main runner with primary and secondary outlets. In the preferred embodiment the secondary outlet is a nozzle positioned midway between the lower end of the runner and the blast furnace. During tapping the nozzle is opened and closed to control the flow of metal. When the nozzle is closed molten metal flows down the runner, through a primary outlet and into a bottle car. When the nozzle is open, metal flows through the nozzle into a bottle car positioned beneath the nozzle.

24 Claims, 3 Drawing Figures

RUNNER SYSTEM FOR TRANSFERRING MOLTEN METAL

TECHNICAL FIELD

This invention relates to an apparatus and method for transferring molten metal from a smelting furnace to bottle cars positioned below the furnace. More specifically, the invention relates a novel runner system which extends from a tap hole of the smelting furnace to bottle cars and enables molten metal to be transferred from the furnace to bottle cars without moving runners or manipulating gates to provide sequential flow along each of the runners of a runner network. The disclosed invention is particularly useful in the iron and steel making processes.

BACKGROUND ART

In the smelting of iron ore, as well as other metals, complex runner systems are employed for transferring molten metal from furnaces to transfer cars known as bottle cars. Previous runner systems have consisted of series of runners extending from the tap hole of the smelting furnaces to cars positioned on the floor of a casting house. Other transfer systems have been comprised of a single runner beginning at the tap hole and then diverging into a network of side runners with each side runner going to a different one of a group of bottle cars. Other systems have had moveable runners to direct molten metal sequentially to each of a series of side runners. These runner systems have been plagued with excessive plugging and failure of the gates which control the flow of molten metal. Considerable tapping time has been lost due to these short-comings in equipment. Moreover, many previous transfer systems have required bottle cars to be maneuvered from one track to another. This, too, decreases cast house efficiency.

Other additional problems and disadvantages have been associated with previous runner systems. Currently used runner systems require large amounts of cast house floor space because runner networks of complex design are required. The runners are expensive therefore, the longer the runners the higher the expense. Moreover, the cast house must be large enough to include all of the runners.

The runners of prior systems must be cleaned between casts. This at least in part is a byproduct of the complex systems that have been used. Each branch runner is in use for a relatively short time to fill a bottle car. By the time the furnace tap is completed the first used branch has cooled to the point where some metal solidifies and residual slag is present. The slag reacts with the refractories decreasing their lives and the slag and metal necessitates the cleanup. Because of the cleanup and refractory-slag reactions runners have generally been constructed of sand or other inexpensive refractory materials. Refractory runners last only several casts and then require replacement or repair. Frequent replacement of runners is undesirable because it is expensive and time consuming. During the replacement, the smelting operation must be shut down and valuable smelting time is lost.

DISCLOSURE OF THE INVENTION

The present invention provides a new apparatus and extremely efficient method for transferring molten metal from a smelting furnace to cars for transport. Metal transfer is easily accomplished without the need to recouple bottle cars, transfer metal flow to numerous runners each directed to a different bottle loading station or rotate runners.

In the preferred embodiment, the apparatus is comprised of a single main runner extending from the tap hole of the blast furnace to a transfer car positioned on a track at the downstream end of the main runner and below a primary runner outlet. Between the tap hole and the transfer car, the runner contains a secondary outlet preferably in the form of a bore or nozzle and flow control apparatus which covers the bore.

During casting, the flow control apparatus is adjusted to either allow metal flow through the nozzle or prevent metal flow. When the flow control apparatus is in a position whereby metal flow is substantially prevented, a seal is formed between the nozzle and the flow apparatus and, molten metal flows downstream past the nozzle through the primary outlet into the transfer car positioned at the downstream end of the runner. When the flow control apparatus is in a position where flow is permitted, molten metal flows through the nozzle and into a transfer car positioned on a track beneath the nozzle. A dam is located immediately downstream of the nozzle so that when the flow control apparatus is open, the dam prevents the molten metal from flowing downstream.

During the tapping operation, molten metal is introduced into the main runner. Slag is drained off with an additional trough and is transported to a slag disposal unit. The flow control apparatus is adjusted so that molten metal is prevented from flowing through the bore. The molten metal flows down the runner through the primary outlet and into a first transfer car positioned below the primary outlet. Molten metal is permitted to continue flowing through the primary outlet until the transfer car position at the end of the primary outlet is filled. The flow control apparatus is then adjusted so that molten metal flows through the bore or secondary outlet and into a second transfer car positioned beneath the bore. The first transfer car is then moved and replaced with a third empty transfer car. Once the third transfer car is in place the bore is blocked by adjusting the flow control apparatus and allowing metal to flow down the runner into the third transfer car. When the third transfer car is filled the above procedure is repeated until tapping is completed.

The simplicity of the disclosed runner system and process render it easily adaptable for use in existing cast houses. Since only one main runner is employed a minimum of cast house floor space is necessary. Existing cast houses can be easily modified according to the disclosed invention without the necessity or expense of building either a new cast house or additional floor space.

Another advantage of the disclosed runner system is that it is significantly shorter than previously known runners. The economic benefits of this feature are significant. Cast house runners must be frequently replaced. Existing runner systems range in length from approximately 80 to 200 feet. The disclosed runner system is approximately 140 feet shorter than one currently employed runner system. The reduced length of the disclosed runner systems reduces the cost of replacement materials as well as reduces the labor cost of replacement. Additionally the time required for replacement is minimized, therefore the down time is reduced and additional pours are possible.

The single runner system of the disclosed invention is extremely efficient. In the disclosed system there is only one main runner and one primary outlet. Therefore, all the molten metal flows down this runner and heats this runner. In contrast, in multiple runner systems the molten iron must heat several runners. In multiple runner systems the iron loses a great amount of temperature. When a single runner is used, the runner remains hotter. More importantly because the runner is heated to higher temperatures and heated for longer times, the retained heat keeps any residual metal in the runner molten between furnace heats. Thus, the runner clean up after each heat can be and is eliminated and the furnace is tapped at greatly improved frequencies so that furnace output is increased significantly.

In the disclosed invention, a single main runner extends from the tap hole to a transfer car and contains a bore or aperture approximately midway between the lower end of the runner and the tap hole. In the preferred embodiments a small extension is connected to the runner and contains the aperture. The extension is constructed of the same material as the main runner. An advantage of having the extension is that the metal level in the bottle car positioned beneath the aperture is easily identified.

In the preferred embodiment the bore is nozzle shaped. Inside the runner the nozzle is approximately 6 inches in diameter and tapers down to 5.5 inches. The aperture must be large enough to permit enough molten metal to flow through without the molten metal overflowing the dam located downstream of the aperture. The above dimensions are sufficient to accommodate the flow of molten metal in a typical tapping procedure. Although the preferred embodiment uses a cylindrical shaped aperture, other shapes are suitable.

The nozzle block in the preferred embodiment can be constructed of pitch impregnated fireclays or alumina. The higher the content of alumina in the nozzle block the longer the nozzle will last. The life of the nozzle is related to the amount of slag which contacts the nozzle. Therefore, if good slag/metal separation is maintained and the runner is not drained between casts, nozzle life will be greatly extended. Scraping the nozzle to remove slag buildup between casts will also increase the life of the nozzle. The life of the nozzle may also be increased by repairing or replacing the nozzle with suitable refractories.

A stopper is constructed to fit within the nozzle and prevent metal from flowing through the nozzle when the stopper is lowered. When the stopper is in the raised position, above the runner, molten metal flows through the nozzle into a bottle car positioned directly below the nozzle. A dam, located in the main runner immediately downstream of the aperture, prevents metal from flowing downstream when the stopper is raised.

The stopper is cylindrical shaped with the end that is lowered into the nozzle being rounded. The stopper must be shaped so that when it is in the lowered position it forms a seal with the nozzle and substantially blocks any molten metal from seeping out of the nozzle. In the preferred embodiment, the stopper is constructed in one section, but multiple section stoppers can be utilized. Generally, the stopper is constructed of fireclays with graphite.

The stopper also contains adjustment apparatus which enables the stopper assembly to be raised, lowered and moved laterally relative to the aperture. The adjustment apparatus can be either simple mechanical, air cylinder drive with mechanical override or electric hydraulic with an accumulator.

Although the preferred embodiment uses a stopper assembly it is also possible to utilize a sliding gate or other known mechanisms, to prevent metal flow through the aperture.

Accordingly, an object of the invention is to provide a novel and improved hot metal runner system and a method of tapping molten metal.

BEST MODE FOR CARRYING OUT THE INVENTION

Figure 1:
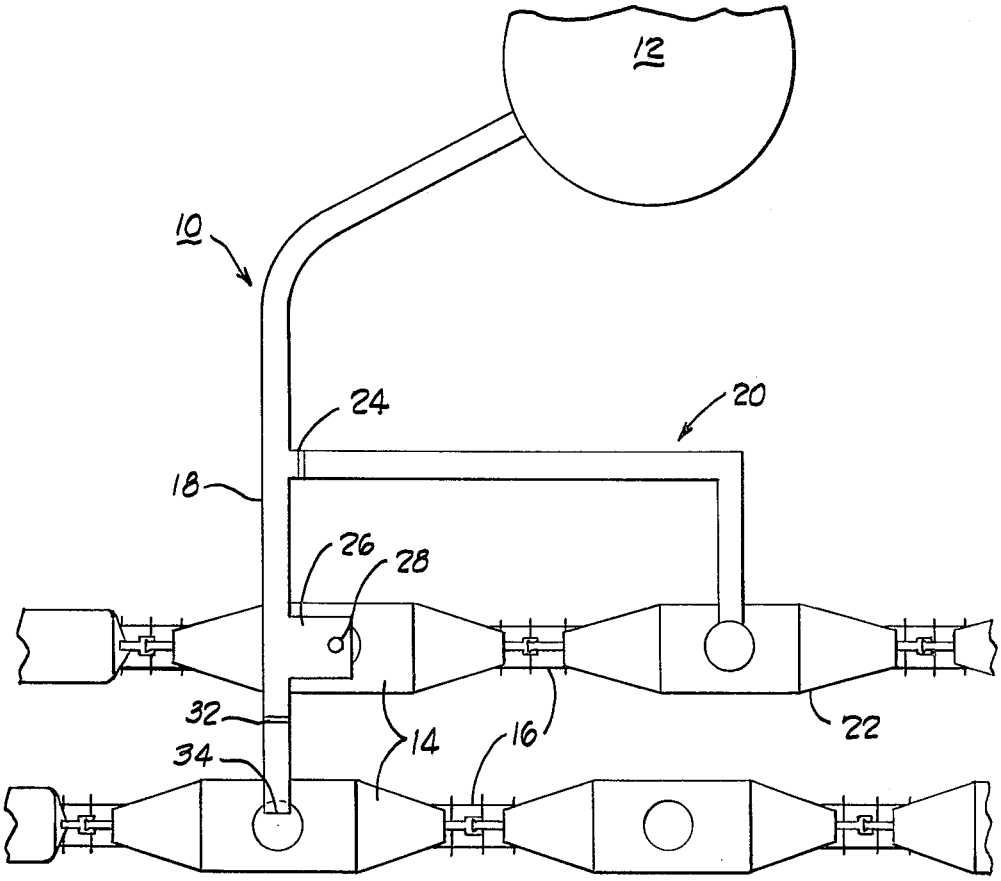
FIG. 1 is a diagrammatic plan view of the runner system and cast house floor.

Referring now to the drawings, FIG. 1 shows a runner system 10 extending from a blast furnace 12 to bottle cars 14 located on tracks 16 below. A main runner 18 extends from the blast furnace to bottle cars positioned below. The system requires only one main runner for transporting iron from the blast furnace to cars for transport.

While only the main runner 18 is required, an emergency runner 20 extends laterally from the main runner to an emergency bottle car 22 located on the track below. A gate 24 positioned between the emergency runner and the main runner prevents the flow of metal to the emergency runner. The emergency runner is utilized if a control dam 32 breaks. When the emergency runner is utilized, the gate 24 is removed and iron flows from the blast furnace to the main iron runner to the emergency runner and into the emergency bottle car. The existance of an emergency runner prevents shutdown and possible waste which could occur if the dam 32 breaks.

A lateral extension 26 contains a nozzle 28 and extends laterally from the main runner. The extension 26 is located between the lower bottle car and the emergency runner 20. The extension and the emergency runner are constructed of the same refractory materials as the main runner.

The control dam 32 is located immediately downstream of the lateral extension 26. The control dam prevents the downstream flow of molten metal when metal is flowing through the nozzle 28. When the stopper rod is lowered so that the nozzle is blocked, molten iron flows over the dam and downstream into a lower bottle car. The control dam is high enough to prevent overflow when the stopper rod is raised. In the preferred embodiment, the control dam is 12 inches high.

Figure 2:
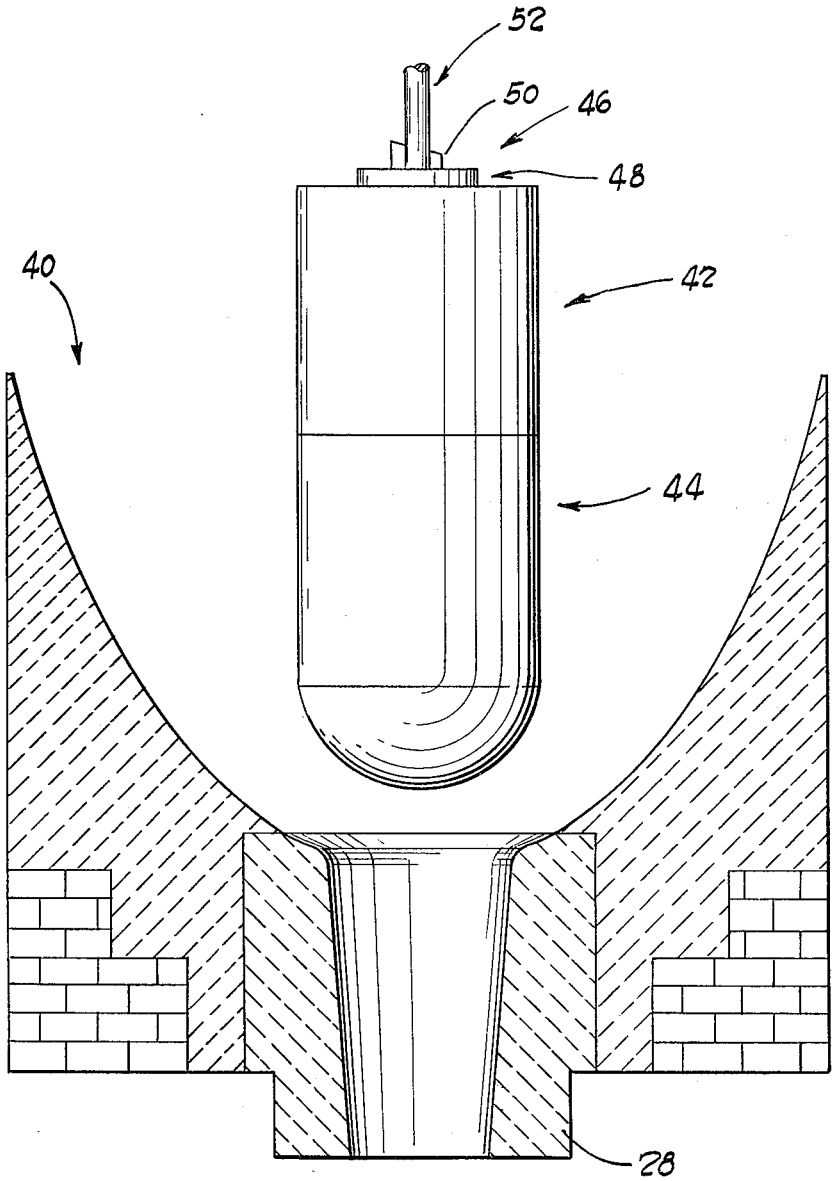
FIG. 2 is a cross sectional view of a stopper rod and nozzle block.

Referring now to FIG. 2, a nozzle block and stopper rod assembly are shown. The block assembly is shown generally at 40 and includes the nozzle 28 and the assemblies coact to provide selective flow to a desired bottle car. The nozzle 28 is preferably constructed of either 90% alumina, or class C fireclays. If the nozzle is constructed of alumina, more than six tappings can be carried out before replacement is required. If the nozzle is constructed of less expensive fireclays, the nozzle will have to be replaced approximately every three taps, but nozzle life can be extended by patching with suitable refractories. The life of the nozzle is directly related to the amount of slag contacting the nozzle. The use of a side extension minimizes the amount of slag contact with the nozzle.

In a system which has been tested, the nozzle had an inside diameter of six inches. This is sufficient to handle flow rates of up to 16 new tons of hot metal per minute. In the tested system the upper portion of the nozzle was six inches and tapered to $5\frac{1}{2}$ inches.

The stopper rod assembly of the preferred embodiment is shown generally in FIG. 2. The stopper rod assembly 42 is comprised of a stopper 44 and a lifting section 46. The stopper is constructed of fireclay. The stopper is shaped and sized so that when it is lowered into the nozzle there is a close fit and flow is prevented. The stopper has a lower blunt or semi-blunt end.

The lift section 46 is comprised of a washer 48, a wedge 50 and a steel rod 52. The steel rod is connected to a lift mechanism (not shown). The steel rod extends from the center of the top of the stopper head up to a lift mechanism.

The washer and wedge are connected to the steel rod and the stopper head. The washer and wedge function to distribute a controlled pressure over a significant portion of the top of the stopper head so that when the stopper is in the lowered position, a seal is formed. Without the wedge and washer, molten iron might destroy the stopper assembly.

The lift mechanism is connected to the steel rod and adapted to shift the stopper upward, downward, and laterally. The lift mechanism can be of several types, either a simple mechanical, air cylinder drive or electric hydraulic with an accumulator.

Figure 3:
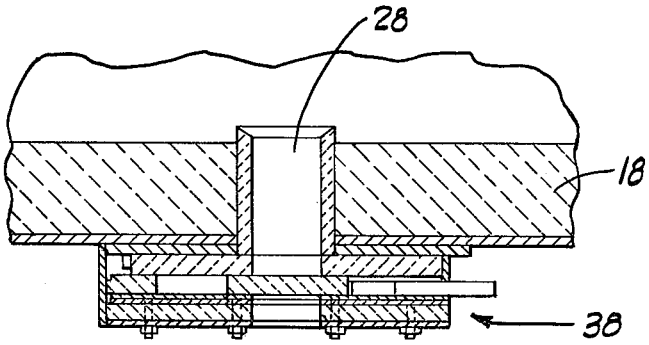
FIG. 3 is a fragmentary cross sectional view of a nozzle block with a sliding gate mechanism.

Referring now to FIG. 3, a fragmentary cross sectional nozzle system with a sliding gate flow control mechanism is shown. In this view the nozzle 28 is located in the main runner 18. A control dam (not shown) is positioned immediately downstream of the nozzle. A sliding gate mechanism 38 can be adjusted to seal the nozzle.

Referring again to FIG. 1, in a typical tapping operation utilizing the disclosed invention a bottle car is positioned below the nozzle 28. A second bottle car is positioned below the downstream end, the primary outlet 34, of the main runner 18. The nozzle 28 functions as a secondary outlet for molten metal and is utilized when the second bottle car, positioned at the downstream end of the runner, is filled.

At the outset of the tapping operation the nozzle 28 is blocked. In the preferred embodiment this is accomplished by lowering the stopper rod assembly into the nozzle and forming a seal between the nozzle and stopper rod. Once a seal is formed the furnace 12 is tapped and molten metal commences to flow down the runner. If the disclosed invention is used in iron smelting, slag is drained off with an additional trough (not shown) which extends from the main runner 18 to a slag pit.

Molten metal continues flowing down the main runner and through the primary outlet 34 until the second bottle car is filled. When the second car is filled the stopper rod is raised above the runner and molten metal flows through the nozzle 28 into the bottle car positioned below. The control dam 32 prevents the metal from continuing downstream past the side extension 26.

While the nozzle is open, the second car, now filled, is moved along the track and replaced with a third empty car. When the third car is in position the stopper rod is lowered into the nozzle and metal flow through the nozzle is blocked. The third car is filled with the metal. The stopper is again raised to allow flow into the first car while a fourth car is positioned beneath the primary outlet. The stopper rod is again lowered and metal is caused to flow over the dam and into the fourth car. If more than four cars are required to receive the entire furnace heat, this procedure is repeated until the tapping operation is completed.

While a preferred embodiment of the invention has been disclosed in detail, various modifications or alterations may be made herein without departing from the spirit or scope of the invention set forth in the appended claims.

We claim:

1. An apparatus for transferring molten metal during a smelting process from a blast furnace to bottle cars comprising:

(a) a main runner extending from the furnace to a downstream end;

(b) said main runner including a generally vertical opening through which molten metal can flow through into a first bottle car station beneath the main runner; and (c) a flow control means to block said opening so that when said opening is covered flowing molten metal will flow downstream past the opening and into another bottle car station near the downstream end of the main runner.

2. The apparatus of claim 1, further comprising an emergency runner extending from the main runner to a third bottle car station.

3. The apparatus of claim 1, wherein the flow control means is a sliding gate.

4. The apparatus of claim 1, wherein the flow control means is a stopper which coacts with structure defining said opening.

5. A metal casting apparatus for transferring molten metal from a blast furnace to transfer cars, comprising:

(a) a main runner including, a primary outlet;

(b) said runner including a nozzle having a bore;

(c) a stopper which coacts with said nozzle; and, (d) stopper control means to raise and lower said stopper so that when said stopper is raised above the runner, molten metal may flow through the bore to a transfer car station beneath the bore and when the stopper is in the lowered position it coacts with the nozzle to close said bore and allow molten metal to flow past the bore downstream to another transfer car station where a car may be positioned to receive metal flowing through the primary outlet.

6. An apparatus for transferring molten metal from a smelting furnace, comprising:

(a) a single main runner extending downward from a tap hole to a first bottle car station at a downstream end of the runner;

(b) the runner including an aperture located between the tap hole and the downstream end of the runner, the aperture being above a second bottle car station;

(c) a stopper rod assembly which can be lowered to close the aperture so that when the stopper assembly is lowered molten metal flows past the aperture to the first bottle car station at the end of the runner;

(d) lifting means to raise and lower the stopper rod assembly, said stopper rod when raised being above the aperture to permit molten metal to flow through the aperture into the second bottle car station; and (e) a dam located downstream of the aperture which dam is adapted to prevent the flow of molten metal downstream when the stopper rod assembly is in the raised position.

7. A process for tapping molten metal from a blast furnace to transfer cars characterized by the steps of:

(a) introducing molten metal into a main runner which extends from the blast furnace to a first transfer car and wherein said runner contains a bore and a flow control means which can be adjusted to either prevent metal flow into the bore or allow metal flow through it;

(b) adjusting the flow control means to prevent metal flow through the bore, (c) allowing metal to flow down the runner into the first transfer car positioned at the downstream end of the runner until a desired quantity of metal is in said first transfer car;

(d) adjusting the flow control means so that molten metal flows through said bore and into another transfer car positioned directly beneath said bore;

(e) moving the first transfer car and positioning still another empty transfer car at the downstream end of said runner; and (f) repeating steps b through e until the tapping process is completed.

8. A process for tapping molten metal from a furnace with a single runner comprising:

(a) positioning a first bottle car below a secondary outlet from the runner;

(b) positioning a second bottle car below a primary outlet of the runner;

(c) blocking flow through the secondary outlet;

(d) tapping an associated furnace to cause molten metal to flow along the runner over a dam downstream of the secondary outlet and through the primary outlet substantially to fill the second car;

(e) opening the secondary outlet and allowing the dam to function to stop flow through the primary outlet;

(f) moving the second bottle car and positioning a third bottle car below the major outlet;

(g) reblocking the secondary outlet to cause molten metal to again flow over the dam;

(h) maintaining the secondary outlet reblocked until the third bottle car is substantially filled and then again reopening the secondary outlet.

9. The process of claim 8 wherein additional bottle cars are positioned beneath the major outlet while the secondary outlet is open and sequentially filling the additional cars by reblocking the secondary outlet each time an additional empty car has been positioned below the major outlet substantially to fill additional cars until an entire furnace heat has been tapped.

10. The process of claim 8 further including the step of diverting flow to an emergency car positioned below an emergency runner.

11. An apparatus for transferring molten iron from a blast furnace to transfer cars during a tapping procedure comprising:

(a) a main runner extending from a tap hole of the blast furnace to a first transfer car station near the outlet end of said runner;

(b) the runner including a secondary outlet portion between the blast furnace and the outlet end of said runner;

(c) the secondary outlet portion including a secondary outlet through which molten iron can flow to a second transfer car station beneath said secondary outlet;

(d) a flow control assembly which is coactable with said secondary outlet and can be moved to prevent or allow iron flow through the secondary outlet and further comprises:

(i) a flow control element including a surface which is complimental to a portion of the secondary outlet, (ii) an element manipulating member extending from the element, and, (iii) a power mechanism connected to the member to move the element from a flow enabling to a flow preventing position and return selectively to provide and prevent molten metal flow through the secondary outlet; and (e) a dam positioned downstream of the secondary outlet portion to prevent the flow of molten iron downstream when the member is in its flow enabling position.

12. The apparatus of claim 11 wherein an emergency runner extends from said main runner to a third transfer car station.

13. An apparatus for transferring molten iron from a blast furnace to transfer cars during a tapping procedure comprising:

(a) a main runner extending from a tap hole of the blast furnace to a first transfer car station near the outlet end of said runner;

(b) the runner including a secondary outlet portion between the blast furnace and the outlet end of said runner;

(c) the secondary outlet portion including a lateral extension having a nozzle through which molten iron can flow to a second transfer car station directly beneath said nozzle;

(d) a stopper rod assembly which is coactable with a surface of said nozzle and can be moved to prevent or allow iron flow through the nozzle and further comprises:

(i) a stopper portion including a surface which is complimental to said nozzle surface, (ii) a rod extending from the stopper portion, and, (iii) a lift mechanism that enables the stopper portion to be shifted upward, downward and laterally relative to said nozzle; and (e) a dam positioned downstream of the lateral extension in said runner to prevent the flow of molten iron downstream when the stopper is raised above the runner.

14. An apparatus for transferring molten iron from a blast furnace to transfer cars during a tapping procedure comprising:

(a) a main runner extending from a tap hole of the blast furnance to a first transfer car station near the outlet end of said runner;

(b) the runner including a lateral extension positioned between the blast furnace and the outlet end of said runner;

(c) the lateral extension containing a nozzle through which molten iron can flow to a second transfer car station directly beneath said nozzle;

(d) a stopper rod assembly which is coactable with a surface of said nozzle and can be moved to prevent or allow iron flow through the nozzle and further comprises:

(i) a stopper portion including a surface which is complimental to said nozzle surface, (ii) a rod extending upward from the stopper portion, and, (iii) a lift mechanism that enables the stopper portion to be shifted upward, downward and laterally relative to said nozzle;

(e) a dam positioned downstream of the lateral extension in said runner to prevent the flow of molten iron downstream when the stopper is raised above the runner; and (f) an emergency runner extending from said main runner to a third transfer car station.

15. The apparatus of claim 14 wherein there is a rod to stopper connection which includes a force distribution means to distribute forces over a substantial area whereby to assure effective sealing contact between the stopper and the nozzle when they are in engagement.

16. An apparatus for transferring molten metal from a blast furnace to transfer cars during a tapping operation, comprising:

(a) a main runner extending from a tap hole of the blast furnace to a first transfer car station near a primary outlet of said main runner, said main runner having a concave inner surface and being constructed of refractory materials;

(b) an extension extending laterally from said main runner to provide a secondary outlet portion comprising:

(i) a secondary outlet through which molten metal from the blast furnace can flow into a second transfer car station positioned on tracks below said secondary outlet; and, (ii) said secondary outlet being a frustrum shaped aperture;

(c) a flow control assembly positioned above the secondary outlet and which is coactable with said secondary outlet and is capable of movement to prevent or allow flow through the secondary outlet and further comprises:

(i) a cylindrical stopper portion which can be lowered into said secondary outlet to form a seal to prevent metal flow through said secondary outlet;

(ii) a rod extending upward from said stopper portion;

(iii) a wedge associated with said stopper and said rod and which exerts a constant downward force on the stopper and insures a seal is formed between the stopper portion and the secondary outlet when said stopper portion is in a lowered position;

(iv) a washer portion in communication with said stopper portion and said rod; and, (v) a lift mechanism enabling the stopper portion to be shifted upward, downward and laterally relative to the secondary outlet;

(d) a control dam positioned downstream of the secondary outlet in the main runner and being of sufficient height to prevent downstream flow of molten metal when the stopper portion is adjusted to allow molten metal flow through the secondary outlet;

(e) an emergency runner extending from the main runner to an emergency transfer car station.

17. An apparatus for transferring molten metal from a blast furnace to transfer cars during a tapping operation, comprising:

(a) a main runner extending from a tap hole of the blast furnace to a first transfer car station near a primary outlet of said main runner, said main runner having an inner surface;

(b) a secondary outlet through which molten metal from the blast furnace can flow into a second transfer car station positioned on tracks below said secondary outlet; and, (c) a flow control assembly positioned above the secondary outlet and which is coactable with said secondary outlet and is capable of movement to prevent or allow flow through the secondary outlet and further comprises:

(i) a stopper portion which can be lowered into said secondary outlet to form a seal to prevent metal flow through said secondary outlet;

(ii) a lift mechanism enabling the stopper portion to be shifted upward, downward and laterally relative to the secondary outlet; and (d) a control dam positioned downstream of the secondary outlet in the main runner and being of sufficient height to prevent downstream flow of molten metal when the stopper portion is adjusted to allow molten metal flow through the secondary outlet.

18. An apparatus for transferring molten metal from a blast furnace to transfer cars during a tapping operation, comprising:

(a) a main runner extending from a tap hole of the blast furnace to a first transfer car station near a primary outlet of said main runner, said main runner having an inner surface and being constructed of refractory materials;

(b) an extension extending laterally from said main runner to provide a secondary outlet portion including a secondary outlet through which molten metal from the last furnace can flow into a second transfer car station positioned on tracks below said secondary outlet; and, (c) a flow control assembly positioned above the secondary outlet and which is coactable with said secondary outlet and is capable of movement to prevent or allow flow through the secondary outlet and further comprises:

(i) a stopper portion which can be lowered into said secondary outlet to form a seal to prevent metal flow through said secondary outlet;

(ii) a lift mechanism enabling the stopper portion to be shifted upward, downward and laterally relative to the secondary outlet;

(d) a control dam positioned downstream of the secondary outlet in the main runner and being of sufficient height to prevent downstream flow of molten metal when the stopper portion is adjusted to allow molten metal flow through the secondary outlet; and, (e) an emergency runner extending from the main runner to an emergency transfer car station.

19. An apparatus for transferring molten metal from a blast furnace to transfer cars during a tapping operation, comprising:

(a) a main runner extending from a tap hole of the blast furnace to a first transfer car station near a primary outlet of said main runner, said main runner having an inner surface;

(b) a secondary outlet through which molten metal from the blast furnace can flow into a second transfer car station positioned on tracks below said secondary outlet; and, (c) a flow control assembly positioned above the secondary outlet and which is coactable with said secondary outlet and is capable of movement to prevent or allow flow through the secondary outlet and further comprises:

(i) a stopper portion which can be lowered into said secondary outlet to form a seal to prevent metal flow through said secondary outlet; and (ii) a lift mechanism enabling the stopper portion to be shifted upward, downward and laterally relative to the secondary outlet.

20. An apparatus for transferring molten metal from a blast furnace to transfer cars during a tapping operation, comprising:

(a) a main runner extending from a tap hole of the blast furnace to a first transfer car station near a primary outlet of said main runner, said main runner being constructed of refractory materials;

(b) the main runner including a secondary outlet through which molten metal from the blast furnace can flow into a second transfer car station below said secondary outlet;

(c) a flow control assembly coactable with said secondary outlet and capable of movement to prevent or allow flow through the secondary outlet and further comprises:

(i) a stopper which can be positioned to prevent metal flow through said secondary outlet;

(ii) a stopper moving element connected to said stopper portion; and, (iii) a power mechanism enabling the stopper to be shifted relative to the secondary outlet; and, (d) a control dam positioned downstream of the secondary outlet in the main runner and being of sufficient height to prevent downstream flow of molten metal when the stopper is adjusted to allow molten metal flow through the secondary outlet.

21. The apparatus of claim 20 wherein an emergency runner extends from the main runner to an emergency transfer car station.

22. A method of operating a cast house runner system comprising:

(a) tapping hot metal from a blast furnace;

(b) flowing the hot metal along a flow path in a runner through a primary outlet while flow is inhibited or prevented at a secondary outlet to flow the metal into a first vessel positioned to receive the metal from the primary outlet;

(c) interrupting the metal flow through the primary outlet and establishing flow through the secondary outlet to flow hot metal at least along a part of said flow path into a second vessel;

(d) concurrently with the performance of step c moving the first vessel and positioning a third vessel to receive hot metal from the primary outlet;

(e) re-establishing metal flow through the primary outlet while inhibiting metal flow through the secondary outlet to flow hot metal into the third vessel, and, (f) repeating steps c, d and e with additional vessels as required until the tapping of the blast furnace is complete while concurrently establishing and substantially maintaining a relatively high runner temperature by repeatedly flowing hot metal along such flow path whereby the heat of the runner minimizes hot metal solidification in the runner thereby reducing clean up and runner repair between taps and extending runner life.

23. The method of claim 22 wherein the secondary outlet is located along the runner and between the blast furnace and the primary outlet.

24. The method of claim 22 wherein flow control is accomplished with a dam between the outlets and a flow control valve means coactable with one of the outlets.

* * * * *